United States Patent [19]

French

[11] 4,022,511

[45] May 10, 1977

[54] RECOVERY OF LIQUID AND GASEOUS PRODUCTS FROM AN IN SITU OIL SHALE RETORT

[75] Inventor: Gordon B. French, Rifle, Colo.

[73] Assignee: Occidental Petroleum Corporation, Los Angeles, Calif.

[22] Filed: Mar. 10, 1975

[21] Appl. No.: 556,577

[52] U.S. Cl. ..... 299/2; 166/256; 166/302

[51] Int. Cl.[2] ..... E21C 41/10; E21B 43/00

[58] Field of Search ..... 299/2–5; 166/278, 256, 302, 259

[56] References Cited

UNITED STATES PATENTS

| | | | |
|---|---|---|---|
| 1,913,395 | 6/1933 | Karrick | 299/2 |
| 3,001,776 | 9/1961 | Poollen | 299/4 X |
| 3,228,471 | 1/1966 | Shook | 166/256 |
| 3,406,755 | 10/1968 | Sharp | 166/256 |
| 3,620,301 | 11/1971 | Nichols et al. | 166/257 X |

*Primary Examiner*—Ernest R. Purser
*Assistant Examiner*—William F. Pate, III
*Attorney, Agent, or Firm*—Christie, Parker & Hale

[57] ABSTRACT

An in situ oil shale retort is provided with a retort off gas cooling zone in the in situ retort at the product outlet end of the in situ retort. The kerogen in the in situ retort is converted to liquid and gaseous products by moving a heated gas through a retorting zone in the in situ retort and toward the product outlet end of the in situ retort. The movement of gas through the retorting zone is terminated when the retort off gas moving from the product outlet end of the in situ retort attains a temperature above which the temperature of the retort off gases will deleteriously effect product collection and removal apparatus in a collection zone adjacent to the product outlet end of the in situ retort. A reduced kerogen content of the oil shale in the retort off gas cooling zone as compared with the average kerogen content of oil shale in the in situ retort improves the yield of products from the in situ retort.

21 Claims, 4 Drawing Figures

RECOVERY OF LIQUID AND GASEOUS PRODUCTS FROM AN IN SITU OIL SHALE RETORT

BACKGROUND OF THE INVENTION

This invention relates to an in situ method of retorting oil shale that is particularly effective in the production of liquid and gaseous products from oil shale.

One technique for recovering liquid and gaseous products referred to herein as shale oil, from oil shale is to form an in situ retort in a subterranean oil shale deposit. The oil shale in the subterranean deposit is fragmented to produce the in situ oil shale retort. Typically fragmenting the shale involves forming a void by mining techniques and expanding the adjacent oil shale into the void. This distributes the void volume into interstices between oil shale fragments and provides appreciable gas permeability through the rubble pile of oil shale particles in the in situ report. The fragmented oil shale at the top of the in situ retort is ignited with the aid of a combustible gas and air to form a combustion zone in the in situ retort. After some of the oil shale fragments have been brought to a temperature of about 900° F. air is supplied to the top of the in situ retort to sustain combustion in the combustion zone by the oxidation of the carbon left in the oil shale fragments after the kerogen has been decomposed. Air moving through the combustion zone causes it to proceed slowly through the fragmented shale in the in situ retort. The non-oxidizing fraction of the air, e.g. nitrogen, is heated as it passes through the combustion zone. Such heated nitrogen and the hot products of combustion transfer the heat of combustion to the oil shale in a zone called the "retorting zone" which is on the advancing side of the combustion zone. The kerogen in the oilshale in the retorting zone is converted to shale oil. Thus, a retorting zone moves from the top to the bottom of the in situ retort in advance of the combustion zone, and the resultant shale oil and retort off gases which collectively includes inlet gas, flue gas from the combustion zone and product gas from the retorting zone, pass to a product collection zone adjacent to the bottom of the in situ retort.

When the combustion zone reaches the bottom of the in situ retort, the retort off gases are extremely hot because there is insufficient oil shale between the retorting zone and the point of collection to sufficiently dissipate the heat from the combustion zone. Thus, elaborate arrangements must be installed in the product collection zone to cool the retort off gases to a temperature at which they will not deleteriously affect the product collection and removal apparatus in the product collection zone.

In particular, it is desirable to keep the temperature of the retort off gas and shale oil at the bottom of the in situ retort below about 400° F. The spontaneous ignition temperature of shale oil is about 500° F.; therefore, safety considerations make it preferable to maintain the temperature of the retort off gas moving from the bottom of the in situ retort to the product collection zone at a temperature below about 500° F. Preferably the temperature is below 200° F. to protect seals in product collection and removal apparatus.

SUMMARY OF THE INVENTION

A retort off gas cooling zone is provided in an in situ oil shale retort at the product outlet end of the in situ oil shale retort. The retort off gas cooling zone has a sufficient thermal capacity to reduce the temperature of the retort off gas moving through said cooling zone to a temperature below which the temperature of the retort off gas will not deleteriously affect the product collection and removal apparatus in the product collection zone. Oil shale in the retort off gas cooling zone having an average kerogen content lower than the average kerogen content of the oil shale in the in situ retort provides an in situ retort having a high yield of products based on the recoverable products in the in situ retort.

Kerogen in the in situ oil shale retort is converted to shale oil by moving a heated gas through a retorting zone in the in situ retort and toward the product outlet end of the in situ retort. The movement of heated gas through the retorting zone is continued until the retort off gas moving from the product outlet end of the in situ retort to a product collection zone is at a temperature above which the gas will deleteriously affect product collection and removal apparatus in the product collection zone.

A feature of the invention is the formation of the retort off gas cooling zone adjacent to the bottom of an in situ retort in a stratum of shale having a low kerogen content. Fragments of such shale may be present in the situ retort. As the retorting zone moves down through the in situ retort, the intact oil shale bordering the in situ retort is also partially retorted. However, when the movement of hot gas through the retorting zone is terminated, the shale adjacent to the bottom of the in situ retort remains substantially unretorted because there is a minimal flow of gas for heating it. Since this shale has a low oil content, there is little loss of yield based on recoverable product from the in situ retort. The fragmented shale in the retort off gas cooling zone adjacent to the bottom of the in situ retort can be formed from the low kerogen content oil shale of the stratum without backfilling.

As used in this specification, the term "low kerogen content" means a kerogen content that is substantially lower than the average kerogen content of the fragmented oil shale within the in situ retort as a whole. For example, the average kerogen content of the oil shale within the in situ retort might yield 30 gallons of shale oil per ton of oil shale, and a low kerogen content oil shale might yield less than about 15 gallons of shale oil per ton of oil shale.

BRIEF DESCRIPTION OF THE DRAWINGS

Features of a specific embodiment of carrying out the invention are illustrated in the drawings, in which.

DETAILED DESCRIPTION OF THE SPECIFIC EMBODIMENT

Figure 1:
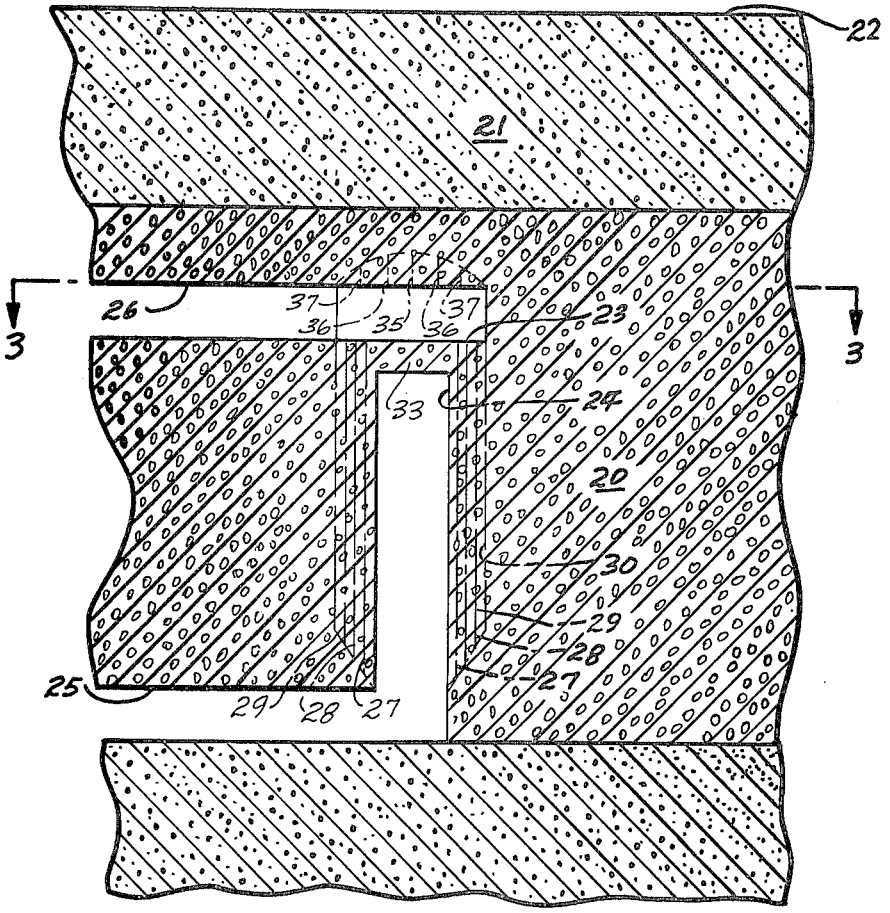
FIG. 1 is a side sectional view of a portion of a subterranean oil shale deposit prior to formation of an situ retort.
Figure 2:
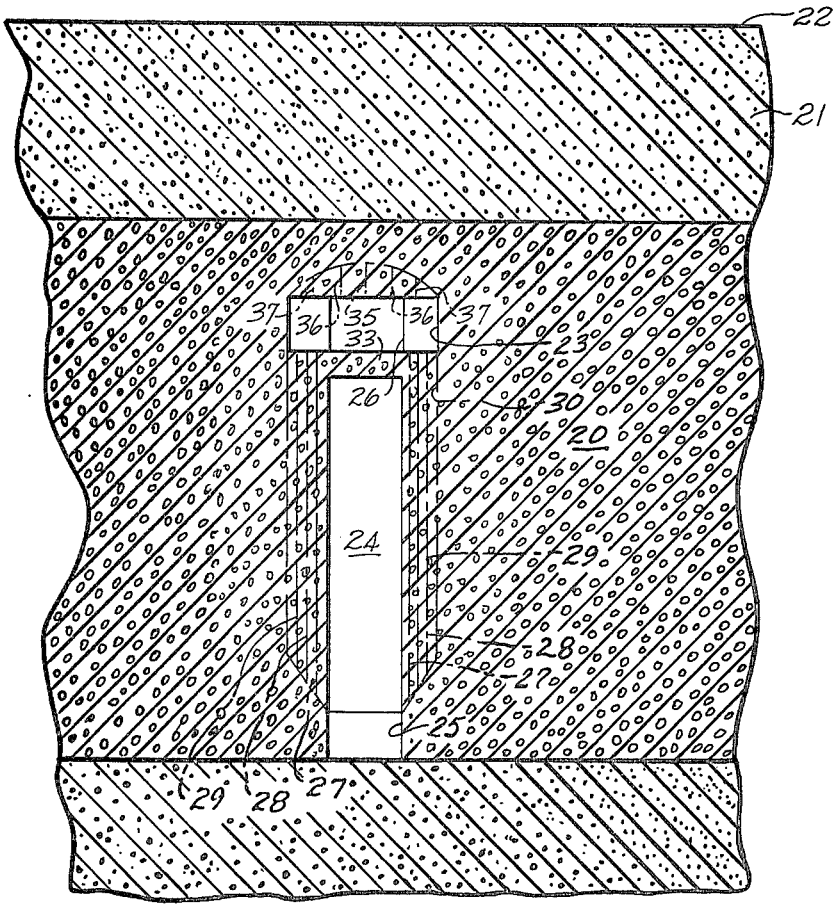
FIG. 2 is a front sectional view of the in situ retort of FIG. 1.
Figure 3:
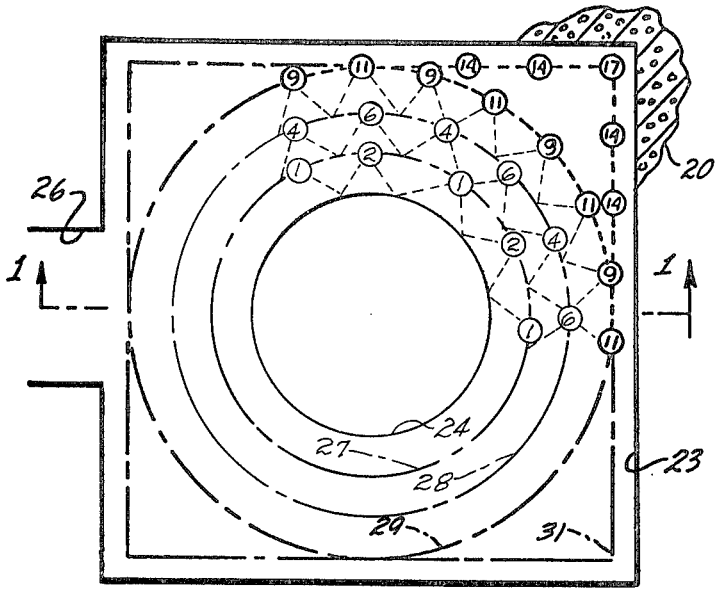
FIG. 3 is a top sectional view of the in situ retort of FIG. 1.

Reference is made to FIGS. 1, 2, and 3, which depict a horizontal subterranean oil shale formation or deposit 20, and overburden 21, and ground level at 22. To prepare the oil shale deposit 20 for in situ recovery of shale oil, a horizontal room 23, a vertical raise 24, and a tunnel 25 are formed therein. Room 23 has a substantially square horizontal cross section and lies near the top of the deposit 20, and the raise 24 has a constant diameter over its entire length and extends from below the floor of the room 23 at the intersection of the diagonals of the floor of the room to a lower tunnel 25, which is near the bottom of the deposit 20. If desired, raise 24 could be a non-cylindrical, e.g., a square raise. An upper tunnel 26 connects the room 23 to the ground level either directly or by way of a shaft (not shown). The lower tunnel 25 is also connected to ground level. The room 23, raise 24, and the tunnels 25 and 26 can be formed by conventional mining techniques. If desired, pillars to support the roof of the room 23 are formed by shale left in place during mining. The height of the room 23, which is generally substantially smaller than the dimensions of its floor, is dictated by the space required to work the oil shale deposit 20 in the manner described below. The tunnels 25 and 26 are preferably self-supporting, i.e., narrow enough that their roofs do not subside in the absence of support pillars. In one embodiment, the room 23 is 30 feet high, 100 feet long, and 100 feet wide; the raise 24 is 48 feet in diameter and 250 feet in height; and the tunnels 25 and 26 are 30 feet high and 30 feet wide.

The raise 24 could be formed as disclosed in copending application Ser. No. 505,363, filed Sept. 12, 1974 by Gordon B. French, entitled METHOD OF FRAGMENTING ORE FOR IN SITU RECOVERY OF CONSTITUENTS, the disclosure of which is incorporated herein by reference. The top of the raise 24 terminates below the upper room 23. The oil shale left between the raise 24 and the upper room 23 forms a horizontal slab or "pillar" 33 which supports the floor of the upper room 23. This support provides a room 23 which is free from a hazardous condition, namely, a large opening, during the operations subsequently conducted therefrom. The debris created during formation of the raise 24 is transported through the lower tunnel 25 to ground level.

The shale in the in situ retort 30, represented in FIG. 1 by phantom lines, is to be fragmented for the purpose of recovering shale oil therefrom by an in situ retorting operation. The volume of the in situ retort 39 is defined approximately by the horizontal cross section of the room 23 and the height of the raise 24. The in situ retort has substantially vertical sides, a top, and a bottom. The fragmentation of the oil shale to form the in situ retort distributes the void volume of the room and raise within the in situ retort into the interstices between oil shale fragments to provide substantial permeability so that gas can be moved through the in situ retort with low pressure. A sufficient void volume is required that the energy required to move gas through the in situ retort is minimized. However, the removal of oil shale from the formation to provide void volume in the in situ retort is expensive and must also be minimized.

The void volume or void fraction of the fragmented shale in the in situ retort depends upon the ratio of the volume of raise 24 and room 23 to the volume of the in situ retort 30 to be formed. Thus, to achieve a given void volume in a retort, one selects a raise 24 of a given diameter (and height) and therefore of a given volume, and a room 23 of given dimensions. In a preferred embodiment of the invention, the shale surrounding the raise 24 in the in situ retort 30 is explosively expanded toward the center of the raise 24 from a plurality of concentric annular rings of blasting holes extending into the oil shale deposit parallel to raise 24.

To prepare the region around the raise 24 for explosive expansion, concentric rings 27, 28, and 29 of vertical blasting holes extending parallel to raise 24 are drilled downwardly from room 23 along the length of raise 24. Although three rings are shown, more may be required for larger in situ retorts. A closed square border or band 31 of vertical blasting holes covers the corners of the region to be fragmented. Border 31 defines the horizontal cross-sectional area of in situ retort 30.

The explosives in the rings and square band of blasting holes are consecutively detonated in rapid sequence progressing outwardly from the innermost ring to the outermost band. The oilshale within each ring of blasting holes is completely severed from the adjoining shale on the outside of said ring to form a free face prior to the severance of the next layer. A room can also be formed at the bottom of the deposit to serve as a base of operations with a raise above the room, and blasted in the same general manner for fragmenting the oil shale. In one embodiment in which the cross-sectional area of the in situ retort 30 was about 1000 square feet, and the vertical height of the in situ retort 30 was about 80 feet, it was found that the shale fragmented well throughout and 1 psi of pressure was required to achieve a gas flow rate of about one standard cubic foot per minute (SCFM) per square foot of cross-sectional area of the retort, from top to bottom of the in situ retort.

In situ retort 30 is preferably provided with a dome-shaped top. Accordingly, a blasting hole 35 and concentric rings of blasting holes 36 and 37 are drilled upwardly from room 23. The lengths of these blasting holes vary in accordance with the desired dome shape. The volume of shale included within the dome-shaped top of in situ retort 30 above room 23 is sufficiently large after explosive expansion of the shale that the fragmented shale completely fills the volume within the dome, thereby providing support for overburden 21. If desired to reduce the volume of shale expanded from above room 23, a portion of the oil shale removed in the course of formation of room 23 can be returned thereto prior to explosive expansion.

The entire length of all of the blasting holes are loaded from room 23 with an explosive such as dynamite or ammonium nitrate mixed with fuel oil. The in situ retort is then formed and filled with fragmented oil shale in a single blasting sequence. The floor support 33 below the upper room is explosively fragmented, and the explosive charge in the blasting holes is detonated in the following sequence of steps:

a. ring 27
b. ring 28
c. ring 29
d. border 31, with exception of corner holes
e. the corner holes of border 31
f. hole 35 and rings 36 and 37 simultaneously Thus, the shale adjacent to the raise 24 is explosively expanded into the raise and to some extent into the room 23 in concentric rings moving outwardly from the raise.

Within each ring there is a small delay, e.g., 50 to 100 milliseconds between detonation of alternate holes to cause the shale to break up vertically in the vicinity of the holes. This provides better fragmentation.

The detonators for the blasting holes are provided with delay fuses that are trigered simultaneously. The numbers of these delay fuses are indicated in FIG. 3 inside the respective blasting holes. As measured from the instant of triggering the fuses, the following correspondence between fuse numbers and time delays exists:

| Fuse Number | Time Delay |
|---|---|
| No. 1 | 25 milliseconds |
| No. 2 | 50 milliseconds |
| No. 4 | 100 milliseconds |
| No. 6 | 170 milliseconds |
| No. 9 | 280 milliseconds |
| No. 11 | 320 milliseconds |
| No. 14 | 500 milliseconds |
| No. 17 | 700 milliseconds |

The kerogen content of oil shale deposits is sharply stratified. It is common to have one or more strata of shale having a low kerogen content interspersed at levels of an oil shale deposit having a high overall average kerogen content. In practice of this invention, the fragmented oil shale in a retort off gas cooling zone 32 adjacent to the bottom of the in situ retort 30 preferably has a low kergoen content, i.e., a lower kerogen content than the average kerogen content of the in situ retort 30 as a whole. This can be achieved in either of two ways.

A preferred way is to locate the retort off gas cooling zone adjacent to the bottom of the in situ retort 30 in a stratun of shale having a low kerogen content. This stratum may even be completely barren and have no appreciable kerogen content. When the in situ retort 30 is explosively expanded in the manner described above, the fragmented shale in the retort off gas cooling zone 32 at the bottom of the in situ retort inherently has a low oil content, without necessity for backfilling.

Another way is to mine out a cavity or void in a region adjacent to the bottom of the in situ retort and then to backfill the cavity with fragmented oil shale having a low kerogen content prior to explosively expanding the oil shale in the remainder of the in situ retort 30 above the backfilled cavity.

Figure 4:
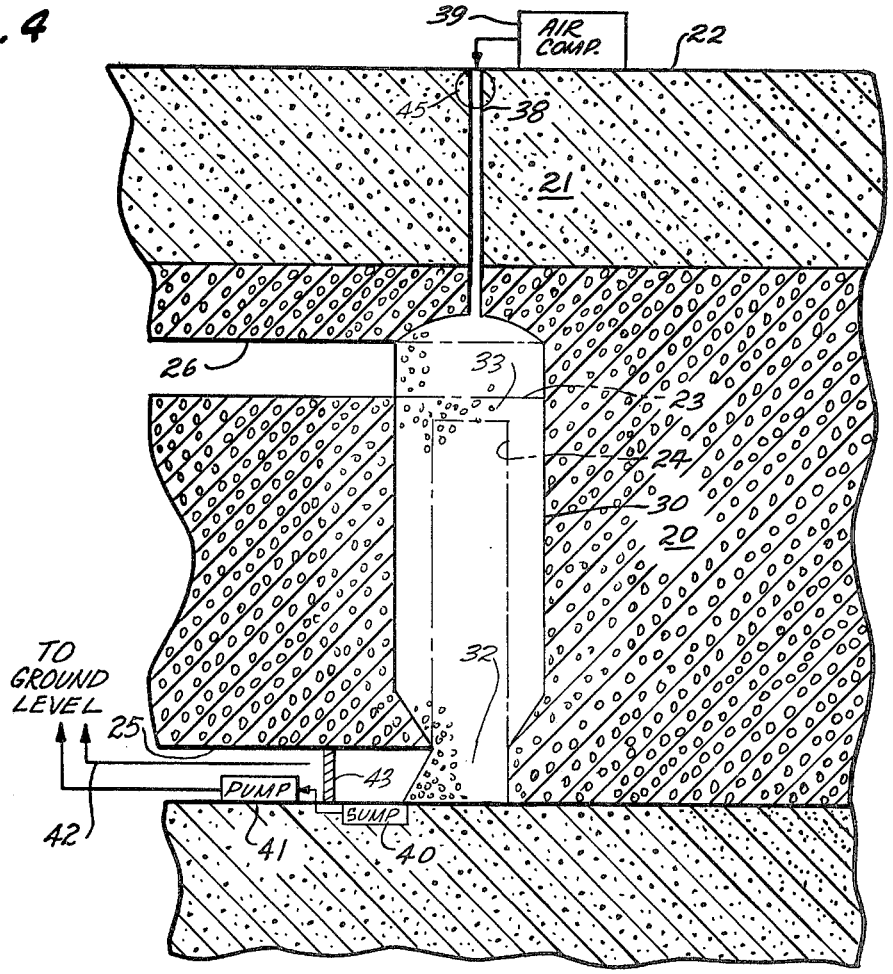
FIG. 4 is a side sectional view of the deposit of FIG. 1 after formation of the in situ retort.

The in situ retort 30 preferably has a funnel-shaped bottom, as illustrated in FIG. 4. In other words, the bottom of in situ retort 30 has an inward converging surface from the vertical sides of in situ retort 30 to a point of convergence at tunnel 25. This bottom may be conical, pyramidal, or irregular inwardly converging shape. The funnel-shaped bottom is preferably formed by drilling vertical blasting holes that have different lengths. Thus, the blasting holes of rings 27, 28, and 29 and border 31, respectively, are incrementally shorter in length than the raise 24 so as to provide the desired slope on the bottom of the in situ retort.

The present invention can be practiced to advantage in conjunction with the invention disclosed in copending patent application Ser. No. 505,276, filed on Sept. 12, 1974, by Gordon B. French, entitled IN SITU RECOVERY OF CONSTITUENTS FROM FRAGMENTED ORE, the disclosure of which is incorporated herein by reference. In other words, the uniformity of gas flow through the in situ retort can be improved by providing the fragmented shale in the region adjacent to the bottom of the in situ retort with a higher void fraction than the remainder thereof.

Reference is made to FIG. 4 which depicts the oil shale deposit after fragmentation of the shale within the in situ retort 30.

A valve 45 and a conduit 38 connect an air compressor or blower 39 located at ground level 22 to the uppermost point of in situ retort 30. Because of the high permeability of the fragmented shale, compressor 39 need only deliver air at about 5 psig or less, which does not require much power. The oil shale fragments at the top of in situ retort 30 are heated to ignition by the combustion of an air combustible gas mixture. When the oil shale at the top has reached a temperature of about 900° F. at which temperature combustion of the residual carbon in the oil shale is sustained in the presence of air, the flow of combustible gas is discontinued and air or other oxygen-supplying gas is fed to the retort through valve 45 by compressor 39. This establishes and maintains a combustion zone in the fragmented shale in the in situ retort. The supply of air to the combustion zone is maintained to advance the combustion zone from the top toward the bottom of the in situ retort with a horizontal combustion front. Oil shale retorting products comprising shale oil and gases are released from the kerogen in the fragmented shale by the heat which is transferred from the combustion zone to a retorting zone a few feet thick on the advancing side of the combustion zone. Kerogen in the retorting zone is decomposed, releasing shale oil and some hydrocarbon gases. The shale pillars bounding the in situ retort are also partially retorted and shale oil is recovered therefrom. Typically the retorting zone may be considered the shale heated above about 900° F. on the advancing side of the combustion zone.

The shale oil percolates downward to the bottom of the in situ retort 30 in advance of the retorting zone, and the flue gases from the combustion zone and product gases from the retorting zone are forced to the bottom of the in situ retort by the movement of gas from the top to the bottom of the in situ retort. Shale oil is collected in a sump 40, which is located at a low point of the lower tunnel 25. The lower tunnel provides an access to the fragmented shale at the point of convergence of the funnel-shaped bottom of in situ retort 30. A pump 41 carries the shale oil from the sump 40 to ground level. A conduit 42 carries the retort off gases recovered from the in situ retort through a sealed bulkhead 43 in the lower tunnel 25 to ground level. Product collection and removal apparatus, such as the pump 41, are provided in a product collection zone in the tunnel 25 connected to the bottom of the in situ retort.

When the combustion zone has advanced through the in situ retort to a level near the bottom of the in situ retort, valve 45 is turned off, thereby terminating the movement of inlet gas from the top to the bottom of the in situ retort. As a result, the combustion zone is gradually extinguished and the remaining gases generated in the combustion and retorting zones are cooled by the fragmented shale in the retort off gas cooling zone 32 adjacent to the bottom of the in situ retort. This fragmented shale in the retort off gas cooling zone remains partially unretorted because it is not heated to the full retorting temperature. The intact shale bordering the retort off gas cooling zone 32 adjacent to the bottom of in situ retort which preferably has a low kerogen content, also remains substantially unretorted. Since this fragmented and intact shale has a low kerogen content, the overall yield of recoverable products from the in situ retort is not appreciably reduced by shutting off the air supply before the retorting zone has traversed the entire height of the in situ retort 30.

Hydrocarbon product gas is released from the oil shale in the retort off gas cooling zone 32 as it is heated and residual heat in the in situ retort continues to produce gas from the balance of the retort after inlet gas flow is terminated. This "post retorting" retort off gas is withdrawn from the bottom of the in situ retort. It is desirable that the temperature of the retort off gas withdrawn from the bottom be less than about 400° F., both during the active retorting stage when the inlet gas is introduced into the top and moved to the bottom of the in situ retort and also during the post-retorting stage when gas continues to be evolved from parts of the fragmented oil shale in the in situ retort and from the intact shale in the pillars adjacent the in situ retort.

The funnel-shaped bottom of in situ retort 30 serves as a heat sink. The intact shale defining the converging surface of the bottom of the in situ retort provides mass for dissipation of heat in the flow path of hot flue gases generated further up in the retort. Since the surface area for contact is less than for fragmented shale, the funnel-shaped bottom is less effective at dissipating heat than the fragmented shale in the off gas cooling zone 32.

The point at which the air supply is terminated by turning off valve 45 depends upon the extent of cooling of the flue gases desired. The more cooling that is desired, the earlier the valve is turned off. In any case, it is preferable that the top of the retort off gas cooling zone 32 having a lower than average kerogen content coincide as nearly as practical with the bottom of the retorting zone, after the air supply is terminated and the advancement of the combustion zone has terminated.

In a typical embodiment, the temperature distribution below the retorting zone is such that there is a distance of about six feet between a temperature of about 900° F. at the advancing lower level of the retorting zone and about 400° F. in the fragmented shale on the advancing side of the retorting zone.

This temperature profile was noted in an in situ retort in which the rate of advance of the combustion zone was about ¾ foot per day. With a rate of combustion zone advance of about two feet per day, a thickness of about fifteen feet is found between temperatures of 400° and 900° F. Thus, for typical operating conditions in an in situ retort it is preferred that the off gas cooling zone have an effective thickness of about ten feet. The required thickness can be minimized by reducing the rate of advance of the retorting zone near the lower end of the retort.

It is preferable that the temperature of the retort off gas moving from the in situ retort to the product collection zone be below about 400° F. since higher temperatures may involve fire hazards in the underground tunnels. Temperatures higher than 400° F. can also destroy seals and otherwise deleteriously affect the product collection and removal aparatus in the product collection zone. Thus, the retorting zone should not be advanced to less than about ten feet of the product outlet end of the in situ retort.

If low temperature seals such as butyl rubber seals are used in product collection and removal apparatus, the retort off gas should be maintained below about 200° F. To maintain the retort off gas at less than about 200° F. at the product outlet end of the retort, it is preferred that the retorting zone not be advanced to within less than about fifteen feet of the product outlet end of the in situ retort; that is, the off gas cooling zone has an effective thickness of about 15 feet.

It is particularly preferred that the movement of the retorting zone be terminated at a sufficient distance from the product outlet end of the in situ retort that the additional off gas produced during the post-retorting stage can transfer heat to the fragmented shale in the cooling zone at the bottom and to the conical bottom and not exceed about 400° F. at the product outlet end of the in situ retort. The volume flow rate of this post-retorting retort off gas is only about 10 to 20 percent of the volume of retort off gas during active retorting. If the retorting zone is advanced to less than about ten feet from the product outlet end of the in situ retort, high product temperatures may be encountered, particularly from post-retorting gas flow.

Although the heat from off gas can be transferred to oil shale in the retort off gas cooling zone having a substantial oil content, this is wasteful since the oil shale is not heated sufficiently to fully decompose kerogen in the oil shale, and the total yield of recoverable product from the in situ retort is diminished. Preferably, the retort off gas cooling zone at the outlet end of the in situ retort is filled with oil shale having a low kerogen content. This does as well in accommodating heat and cooling off gas generated in the in situ retort, and there is no significant amount of shale oil sacrificed. An easy way to accomlish this is to form the retort off gas cooling zone at the bottom portion of the in situ retort in a stratum of lean oil shale having a low kerogen content. When the lean oil shale is expanded, the fragmented oil shale in the retort off gas cooling zone will have a low kerogen content.

The described embodiment of the invention is only considered to be preferred and illustrative of the inventive concepts; the scope of the invention is not to be restricted to such embodiment. Various and numerous other arrangements may be devised by one skilled in the art without departing from the spirit and scope of this invention. For example, the oil shale within in situ retort 30 could be fragmented by techniques other than that disclosed. Although it is preferable to have an in situ retort with a funnel-shaped bottom, advantages of the invention disclosed above can be realized in an in situ retort with a substantially flat bottom, particularly if the fragmented shale in the retort off gas cooling zone adjacent to such a flat bottom has a low kerogen content.

The preferred embodiment employs an oxygen supplying gas as the inlet gas to the top of the in situ retort to sustain and advance the combustion zone. Heat from the combustion maintains a retorting zone on the advancing side of the combustion zone. A retorting zone may also be established and moved through the in situ retort by a substantially oxygen-free hot retorting gas introduced at the top. The described in situ retort is substantially square in horizontal cross section; however, it will be apparent that other shapes can be employed in practice of this invention. Similarly, the preferred in situ retort is essentially vertical, but the cooling effect due to fragmented shale in the retort off gas cooling zone, and preferably fragmented shale having a low kerogen content, can be obtained irrespective of the orientation of the in situ retort.

Practice is enhanced in a vertical retort because of the greater ease of providing an off gas cooling zone containing fragmented lean shale. There are large oil shale deposits having essentially horizontal bedding with a stratum of oil shale having a low kerogen content near the bottom. In a stratum with horizontal bedding, it is particularly preferred to employ a vertical orientation with retorting gas introduced at the top and retort off gas withdrawn from the bottom of the in situ retort.

Many other modifications and variations of a process wherein relatively cool retort off gas is recovered from an in situ retort without significant loss of shale oil yield will be apparent to one skilled in the art.

What is claimed is:

1. An in situ oil shale retort system for conversion of kerogen in oil shale to liquid and gaseous products by passing a gas from a gas inlet end to the product outlet end of said retort, through a retorting zone therein, in a direction to advance the retorting zone through said in situ retort toward the product outlet end thereof, comprising:

an in situ oil shale retort chamber in a subterranean oil shale deposit bounded on all sides by unfragmented deposit and having a gas inlet end and a product outlet end;

fragmented oil shale particles in said chamber;

a gas inlet communicating with the interior of said chamber at said gas inlet end of said chamber through which gas can be introduced into said chamber;

a product collection zone communicating with the interior of said chamber at said product outlet end of said chamber having apparatus therein for collecting and removing liquid and gaseous products from the chamber; and a retort off gas cooling zone at the product outlet end of the in situ retort chamber having sufficient thermal capacity to reduce the temperature of retort off gas such that said retort off gas will not deleteriously affect the product collection and removal apparatus and which contains fragmented oil shale particles having an average kerogen content substantially lower than the average kerogen content of the fragmented oil shale particles in the in situ oil shale retort chamber.

2. An in situ oil shale retort system as recited in claim 1 wherein the retort off gas cooling zone is located at the bottom thereof.

3. An in situ oil shale retort system as recited in claim 2 wherein the retort off gas cooling zone extends in the order of about ten feet above the product outlet end of the in situ oil shale retort chamber.

4. A method of converting kerogen contained in fragmented oil shale to liquid and gaseous products in an in situ oil shale retort having a gas inlet end, a product outlet end and a product collection zone communicating with the interior of said in situ retort at the product outlet end and having product collection and removal apparatus therein, comprising:

establishing a heated retorting zone in said retort wherein kerogen is converted to liquid and gaseous products;

passing a retorting gas through said retorting zone;

collecting liquid and gaseous products in said product collection zone and withdrawing such products therefrom; and terminating the passage of retorting gas through said retorting zone when the temperature of gaseous products being collected approaches a temperature which would deleteriously affect apparatus in the product collection zone.

5. A method of converting kerogen contained in fragmented oil shale to liquid and gaseous products in an in situ oil shale retort having a gas inlet end, a product outlet end, and a product collection zone communicating with the interior of the in situ retort at said outlet end and containing product collection and removal apparatus therein, comprising:

heating a portion of fragmented oil shale in said in situ retort to a temperature sufficient to sustain combustion of carbonaceous material in the fragmented oil shale;

contacting said heated portion of fragmented oil shale with an oxygen-supplying gas to establish a combustion zone in the in situ oil shale retort;

introducing oxygen-supplying gas to the combustion zone in the in situ oil shale retort to sustain said combustion zone and to advance the combustion zone through the retort;

continuing to introduce oxygen-supplying gas to the retort whereby a non-oxidizing portion of said gas, together with flue gas from the combustion zone passes through said in situ oil shale retort between the combustion zone and the product outlet end and heats fragmented oil shale therein to a retorting temperature, thereby establishing a retorting zone on the advancing side of the combustion zone wherein kerogen in the fragmented oil shale is converted to liquid and gaseous products.

collecting liquid and gaseous products in said product collection zone and withdrawing such products therefrom;

and terminating the introduction of oxygen-supplying gas to the retort when the temperature of gaseous products being collected approaches a temperature which would deleteriously affect product collection and removal apparatus in said product collection zone.

6. The method of claim 5 wherein the introduction of said oxygen-supplying gas to the retort is terminated when the advancing side of the retorting zone is in the order of about ten feet from the product outlet end of the in situ retort.

7. The method of claim 5 wherein said combustion zone is advanced from the top and toward the bottom of the in situ oil shale retort.

8. The method of converting kerogen contained in fragmented oil shale to liquid and gaseous products in an in situ oil shale retort having a gas inlet end, a product outlet end, and a product collection zone communicating with the interior of the in situ retort at said outlet end and containing product collection and removal apparatus therein, comprising the steps of:

heating a portion of fragmented oil shale in said in situ retort to a temperature sufficient to sustain combustion of carbonaceous material in the fragmented oil shale;

contacting said heated portion of fragmented oil shale with an oxygen-supplying gas to establish a combustion zone in the in situ oil shale retort;

introducing oxygen-supplying gas to the combustion zone in the in situ oil shale retort to sustain said combustion zone and to advance the combustion zone through the retort;

continuing to introduce oxygen-supplying gas to the retort whereby a non-oxidizing portion of said gas, together with flue gas from the combustion zone passes through said in situ oil shale retort between the combustion zone and the product outlet end and heats fragmented oil shale therein to a retorting temperature, thereby establishing a retorting zone on the advancing side of the combustion zone wherein kerogen in the fragmented oil shale is converted to liquid and gaseous products;

passing said liquid and gaseous products through a gaseous product cooling zone at the product outlet end of the retort containing fragmented shale having a kerogen content substantially lower than average kerogen content of fragmented oil shale in the in situ retort;

collecting liquid and gaseous products in said product collection zone and withdrawing such products therefrom; and terminating the introduction of oxygen-supplying gas to the retort when the temperature of gaseous products being collected approaches a temperature which would deleteriously affect product collection and removal apparatus in said product collection zone, and wherein the step of terminating introduction of oxygen-supplying gas to the retort occurs approximately when the retorting zone reaches the gaseous product cooling zone.

9. The method of claim 5 further comprising the step of continuing to collect and withdraw liquid and gaseous products after the terminating step.

10. A method for recovering shale oil from an oil shale deposit comprising the steps of:

forming, in the deposit, an elongated in situ retort containing a fragmented permeable mass of shale, the in situ retort having an inlet end, a product outlet end, and an off gas cooling zone adjacent to the product outlet end of the in situ retort having fragmented shale therein which has a kerogen content that is substantially lower than the average kerogen content of fragmented shale in the in situ retort;

establishing in said retort a retorting zone wherein kerogen is converted to liquid and gaseous products;

passing a retorting gas through said retorting zone and moving the retorting zone through the in situ retort;

collecting liquid and gaseous products at the product outlet end of the in situ retort and withdrawing such products therefrom;

terminating the flow of retorting gas when the retorting zone reaches the off gas cooling zone.

11. The method of claim 10 in which the off gas cooling zone of the in situ retort has a surface that converges inwardly from the sides of the in situ retort to a point of convergence remote from the inlet end and wherein the liquid and gaseous products are removed from the in situ retort at the point of convergence.

12. The method of claim 11, in which the fragmented shale in the off gas cooling zone has a kerogen content of less than about 15 gallons of shale oil per ton of oil shale.

13. The method of claim 10, in which the step of forming the in situ retort comprises the following steps in the order recited:

removing the shale from a region adjacent to the product outlet end;

backfilling the region adjacent to the product outlet end with fragmented shale having a lower kerogen content than the average kerogen content of fragmented oil shale in the in situ retort; and forming the remainder of the in situ retort.

14. The method of claim 10, wherein the in situ retort is elongated in the vertical direction with a top inlet end and a bottom product outlet end, in which the step of forming the in situ retort comprises the step of:

locating the off gas cooling zone adjacent to the bottom of the in situ retort in a stratum of shale having a substantially lower kerogen content than the average kerogen content of shale in the in situ retort.

15. The method claim 10 wherein the introduction of retorting gas is terminated when the lower boundary of the retorting zone is about ten feet from the product outlet end of the in situ retort.

16. A process for maintaining the temperature of off gas withdrawn at the outlet end of an in situ oil shale retort containing fragmented oil shale below a predetermined temperature which comprises the steps of:

forming, in a subterranean oil shale deposit, an elongated in situ oil shale retort containing fragmented oil shale and having a gas inlet end and a product outlet end, said in situ oil shale retort having means at the product outlet end for collecting and withdrawing shale oil and off gas produced by converting kerogen to shale oil and off gas and for controlling movement of gases from the product outlet end;

heating the fragmented oil shale at a location in the in situ oil shale retort to a sufficient temperature to convert kerogen to shale oil and off gas, thereby establishing a retorting zone in the in situ oil shale retort;

advancing the retorting zone through the in situ oil shale retort to convert kerogen in the fragmented oil shale to shale oil and off gas as the retorting zone advances therethrough;

collecting shale oil and off gas at the product outlet end of the in situ oil shale retort and withdrawing such products therefrom;

terminating appreciable advancement of the retorting zone through the fragmented oil shale when the off gas withdrawn from the product outlet end has reached a predetermined temperature and continuing to withdraw off gas from the product outlet end of the in situ retort after the terminating step.

17. A process for maintaining the termperature of off gas withdrawn at the outlet end of an in situ oil shale retort containing fragmented oil shale below a predetermined temperature which comprises the steps of:

forming, in a subterranean oil shale deposit, an elongated in situ oil shale retort containing fragmented oil shale and having a gas inlet end and a product outlet end, and including forming an off gas cooling zone adjacent the product outlet end of the in situ retort with fragmented shale having a substantially lower kerogen content than the average kerogen content of fragmented shale in the in situ retort, said in situ oil shale retort having means at the product outlet end for collecting and withdrawing shale oil and off gas produced by converting kerogen to shale oil and off gas and for controlling movement of gases from the product outlet end;

heating the fragmented oil shale at a location in the in situ oil shale retort to a sufficient temperature to convert kerogen to shale oil and off gas, thereby establishing a retorting zone in the in situ oil shale retort;

advancing the retorting zone through the in situ oil shale retort to convert kerogen in the fragmented oil shale to shale oil and off gas as the retorting zone advances therethrough;

collecting shale oil and off gas at the product outlet end of the in situ oil shale retort and withdrawing such products therefrom;

terminating appreciable advancement of the retorting zone through the fragmented oil shale when it reaches the off gas cooling zone and when the off gas withdrawn from the product outlet end has reached a predetermined temperature; and continuing to withdraw off gas from the product outlet end of the in situ retort after the terminating step.

18. A process as defined in claim 16 wherein the advancing step comprises introducing a gas for advancing the retorting zone in the end of the in situ retort opposite from the product outlet end and withdrawing retorting off gas from the product outlet end, the volume of off gas withdrawn before the terminating step being substantially greater than the volume of gas withdrawn in the step of continuing to withdraw gas from the product outlet end.

19. A process as defined in claim 18 wherein the elongated in situ retort is substantially vertical; the advancing step comprises advancing the retorting zone in a downward direction; and the terminating step comprises terminating introduction of gas for advancing the retorting zone when the retorting zone reaches the off gas cooling zone.

20. A process as defined in claim 16 wherein the advancing of the retorting zone is terminated before the temperature of the off gas withdrawn from the product outlet end has reached the spontaneous ignition temperature of shale oil.

21. The method of claim 8 further comprising the step of continuing to collect and withdraw liquid and gaseous products after the terminating step.

* * * * *

UNITED STATES PATENT AND TRADEMARK OFFICE

CERTIFICATE OF CORRECTION

PATENT NO. : 4,022,511

DATED : May 10, 1977

INVENTOR(S) : Gordon B. French

It is certified that error appears in the above-identified patent and that said Letters Patent are hereby corrected as shown below:

Column 1, line 36, "oilshale" should be -- oil shale --.

Column 2, lines 25,26, after "the" and before "situ" insert -- in --.

Column 3, line 44, "39" should be -- 30 --.

Column 5, line 2, "trigered" should be -- triggered --.

Column 9, line 15, "the" should be -- a --.

Column 10, line 30, the period should be a semi-colon.

Column 11, line 44, "and" should be -- for --.

Column 12, lines 14, 15, "lower boundary of the" should be deleted.

Column 12, line 58, "with" should be -- containing --.

Signed and Sealed this

*ninth* Day of *August 1977*

[SEAL]

*Attest:*

RUTH C. MASON
*Attesting Officer*

C. MARSHALL DANN
*Commissioner of Patents and Trademarks*